US006168685B1

(12) United States Patent
Ho

(10) Patent No.: US 6,168,685 B1
(45) Date of Patent: Jan. 2, 2001

(54) PROCESS FOR OXIDATION OF CONCENTRATED BLACK LIQUOR

(75) Inventor: Chris Ka Kee Ho, Tarrytown, NY (US)

(73) Assignee: Praxair Canada Inc., Mississauga (CA)

( * ) Notice: Under 35 U.S.C. 154(b), the term of this patent shall be extended for 0 days.

(21) Appl. No.: 08/323,123

(22) Filed: Oct. 14, 1994

Related U.S. Application Data

(63) Continuation-in-part of application No. 08/001,677, filed on Jan. 7, 1993, now abandoned.

(30) Foreign Application Priority Data

Jan. 10, 1992 (GB) ..... 9200466

(51) Int. Cl.[7] ..... D21C 11/04
(52) U.S. Cl. ..... 162/30.11; 162/31; 162/47
(58) Field of Search ..... 162/29, 30.1, 31, 162/47; 210/928, 758

(56) References Cited

U.S. PATENT DOCUMENTS 4,239,589 * 12/1980 Elton et al. ..... 210/758
4,313,788 2/1982 Gulley ..... 162/31
4,718,978 * 1/1988 Spannuth et al. ..... 162/29
5,061,377 10/1991 Lee et al . ..... 210/752

OTHER PUBLICATIONS

Smook, Gary A. "Handbook for pulp & paper Tech", 2nd edition, Angus Wilde Publications, p. 133, 1992.*
Ronald McDonald, "The Pulping of Wood," vol. I, 2nd Ed., pp. 526–529, 1972.*
T.M. Grace, "Increasing Recovery Boiler Throughput", TAPPI Journal, Nov. 1984, pp. 52–58.*
Mc Donald, Ronald, "The Pulping of Wood", 2nd Edition, vol. I, 1969, McGraw Hill Book Co., pp. 614–616.*
Zecchini et al., "A new black liquor oxidation system that is energy efficient", TAPPI Journal, Jan. 1986, pp. 70–73.

* cited by examiner

*Primary Examiner*—Dean T. Nguyen
(74) *Attorney, Agent, or Firm*—Donald T. Black

(57) ABSTRACT

Concentrated black liquor formed in a kraft pulp mill process is treated to effect exothermal oxidation of black liquor solids, so as to heat the concentrated black liquor and consume a proportion of the black liquor solids. Such procedure eliminates the need to use steam to preheat black liquor and decreases the overall heating value of the concentrated black liquor, allowing an increased black liquor recovery boiler capacity to be achieved.

4 Claims, 1 Drawing Sheet

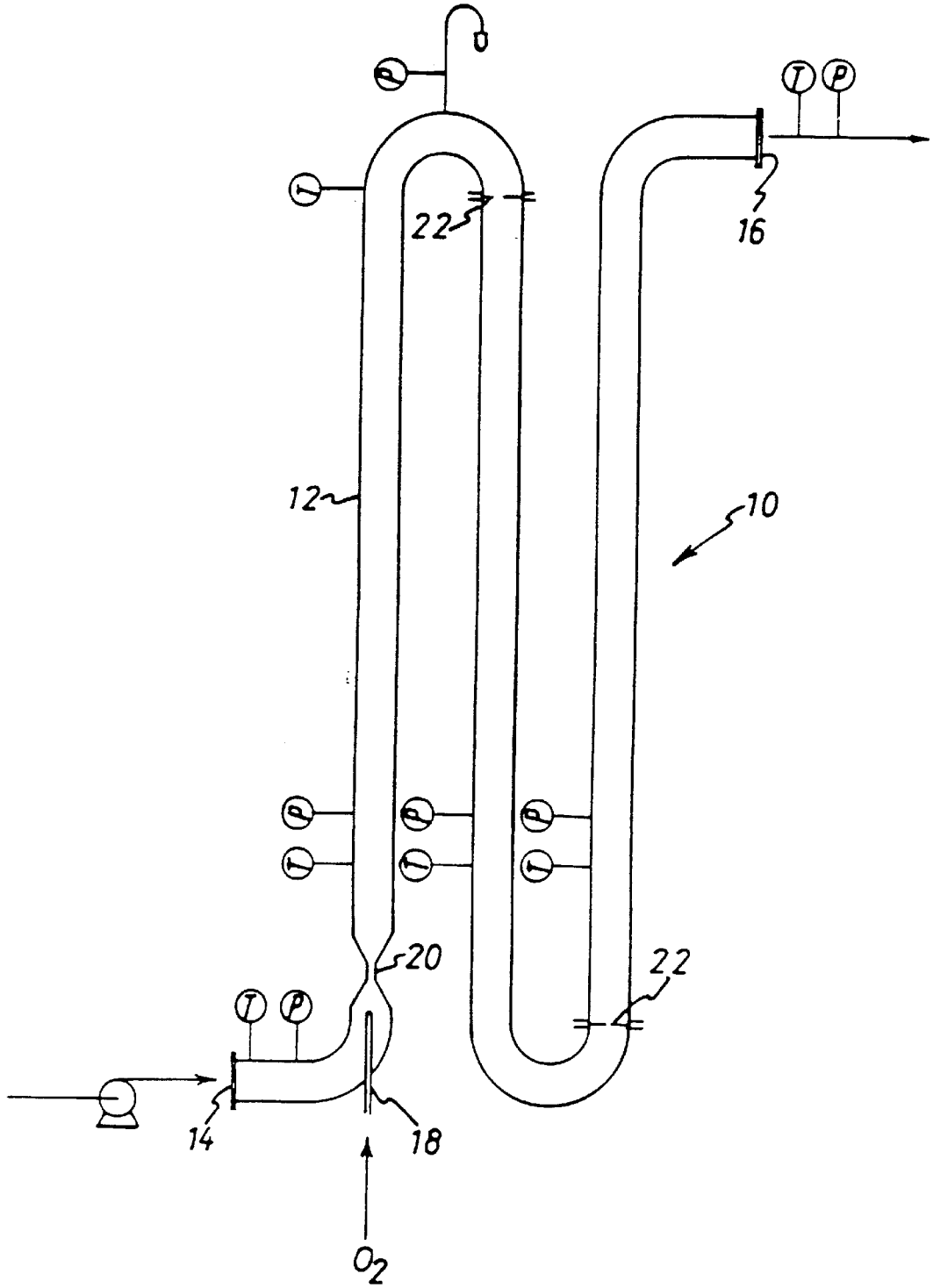
T
P
22
16
12
10
20
22
T
P
14
18
$O_2$

PROCESS FOR OXIDATION OF CONCENTRATED BLACK LIQUOR

REFERENCE TO RELATED APPLICATION

This application is a Continuation of pending prior U.S. application Ser. No. 08/323,123 filed Oct. 14, 1994.

This application is a continuation-in-part of U.S. patent application Ser. No. 08/001,677 filed Jan. 7, 1993 now abandoned.

FIELD OF INVENTION

The present invention relates to the processing of spent digestion liquor from the kraft pulping process.

BACKGROUND TO THE INVENTION

In the pulping of wood by the kraft process, wood chips are digested in a pulping liquor which is an aqueous solution of sodium hydroxide and sodium sulfide (known as white liquor) to dissolve out lignin from the wood chips and free the cellulosic fibres so as to form a pulp. The wood pulp then is washed free from pulping chemicals and usually is forwarded to a bleach plant for brightening.

The spent pulping liquor from the pulping operation, known as black liquor, usually is concentrated and then is combusted in a recovery boiler to burn off its carbon content. Usually, the concentrated black liquor is heated with steam to lower its viscosity prior to combustion. The residual mass, known as smelt, then is further processed to form white liquor for recycle to the digestion step.

Since the spent pulping liquor contains sodium sulfide and other sulfur compounds which are themselves malodorous or which form hydrogen sulfide and/or other malodorous sulfur compounds, it is common practice to subject the sulfur-carbon black liquor to oxidation at some selected stage in the sequence, in order to convert the sodium sulfide and/or other sulfur compounds to more stable compounds, generally sulfates and thiosulfates.

This oxidation procedure, commonly known as BLOX (black liquor oxidation), also involves the evolution of heat and U.S. Pat. No. 4,239,589 proposes a procedure to effect recovery of this heat of reaction. In particular, this prior art locates the BLOX step between the first effect evaporation and the flash tank of the multiple effect concentration used to initially concentrate the dilute black liquor from the pulping operation to about 50% solids concentration.

This prior art also describes conventional BLOX polishing in which the concentrated black liquor is further oxidized to convert any residual oxidizable sulfur compounds to stable form and further concentration of the black liquor to about 65% solids concentration, before feeding to the recovery boiler.

The capacity of a pulp mill to produce wood pulp often is determined by the capacity of its recovery boiler. By employing the procedure of the present invention, as described below, the recovery boiler is able to accommodate larger amounts of solids throughput, thereby increasing the production capacity of the mill.

SUMMARY OF INVENTION

In accordance with the present invention, heating of the concentrated black liquor with steam prior to combustion in the recovery boiler is eliminated but rather the concentrated black liquor is preheated by exothermic oxidation of solids present in the concentrated black liquor. Oxidation of solids in this way both generates energy to heat the concentrated black liquor and decreases the heating value of the solids in the concentrated black liquor, thereby permitting a production capacity increase in the recovery furnace, theoretically equivalent to the percentage of the heating value reduction.

Accordingly, the present invention provides an improvement in a process wherein cellulosic fibrous material is digested with a pulping liquor comprising sodium sulfide and sodium hydroxide to form a pulp and a black liquor, separating the pulp from the black liquor, the black liquor first is concentrated and oxidizable sulfur compounds in the black liquor are oxidized to a stable form and then the concentrated black liquor is combusted to burn off carbonaceous material and form a smelt, and the smelt is processed to form white liquor.

The improvement provided by the present invention comprises preheating concentrated black liquor substantially free from oxidizable sulfur compounds to form preheated concentrated black liquor by exothermic oxidation of black liquor solids contained in the concentrated black liquor, whereby the preheated concentrated black liquor is provided with a decreased heating value, and feeding the preheated concentrated black liquor to the combustion step.

The oxidation process which is effected herein is carried out on concentrated black liquor which has already been oxidized by the BLOX process to convert sulfur compounds to sulfate or thiosulfate, for example, by any of the procedures described in the aforementioned U.S. Pat. No. 4,239,589. The BLOX process does not consume black liquor solids.

The oxidation process effected herein consumes carbonaceous material present in the concentrated black liquor although any residual unoxidized sulfur compounds which may be present also will be oxidized thereby.

BRIEF DESCRIPTION OF DRAWINGS

The sole FIGURE of the drawing is a schematic representation of an apparatus for carrying out the process of the invention.

GENERAL DESCRIPTION OF INVENTION

As mentioned above, the present invention involves a novel manner of processing black liquor from a kraft pulp mill process to improve recovery boiler capacity by consuming a portion of concentrated black liquor solids while heating the concentrated black liquor with the thermal energy so generated.

The oxidation process which is carried out in accordance with the present invention is designed to effect oxidation of black liquor solids in concentrated black liquor which has been pretreated to convert oxidizable sulfur compound, mainly sulfides and sulfites, to stable form, mainly sulfate and thiosulfate. During the oxidation procedure of the invention, any residual unoxidized sulfide and sulfite compounds first are oxidized, simple organics, such as some monosaccharides, then are oxidized and finally some lignin compounds.

As the black liquor solids are oxidized, large amounts of thermal energy are released, which raises the temperature of the black liquor while at the same time decreasing the heating value of the solids and hence the energy to be released upon combustion of concentrated black liquor in the recovery boiler. In addition to eliminating or at least decreasing the need to use steam for black liquor preheating and increasing the solids loading capacity of the recovery boiler, the present invention may have the additional advantages of a decrease in the flue gas volume and dew point of the recovery boiler due to the elimination of the direct steam heating, and, as a consequence, an increase in net energy production from the black liquor solids present in the concentrated black liquor.

DESCRIPTION OF PREFERRED EMBODIMENT

Referring to the drawing, an oxidation apparatus 10 according to one embodiment of the invention takes the form of an insulated pipe 12 having an inlet end 14 to which is fed substantially oxidizable sulfur compound free concentrated black liquor from a pulp mill black liquor evaporator and an outlet end 16 from which the oxidized concentrated black liquor is fed to the recovery boiler. Other forms of reactor which may be used to effect the oxidation procedure of the present invention include a continuous stirred tank reactor (CSTR), a fluidized bed reactor, an advance gas reactor (AGR) and a pipeline contactor/reactor.

An oxygen inlet pipe 18, which may take the form of a sonic nozzle or sparger, communicates from the exterior to the interior of the pipe 12 adjacent a reduced diameter region 20 in the pipe 12. Oxygen or other oxidizing gas, such as air, is fed by pipe 18 into the concentrated black liquor flowing in the pipe 12 from the inlet 14 to the outlet 16, so as to be dispersed therein. Multiple oxygen injection points to the pipe 12 may be provided, as desired.

In addition to the illustrated oxygen feed means, other devices may be employed to disperse oxygen uniformly in the concentrated black liquor and/or to redistribute coalesced gas bubbles, including orifice plate, venturi flow restriction, G-L nozzle, supersonic or sonic nozzle, static mixers, spargers which may be ceramic, sintered metal, porex, and conventional turbine mixers.

The substantially oxidizable sulfur compound free concentrated black liquor fed to the inlet end 14 may have any convenient concentration and temperature. In general, the solids concentration may range from about 50 to about 70 wt % and the concentrated black liquor temperature may vary from about 80° C. to about 150° C. For example, the concentrated black liquor fed to the inlet end 14 may have a concentration of about 65 to 67 wt % solids and a temperature of approximately 110° C.

The pipe 12 may be equipped with a flow restriction device 22 in the form of an orifice plate or similar device, for example, a venturi, after each bend in the pipe 12 to assist in redistributing any coalesced oxygen bubbles. The quantity of oxygen contained in the gas fed to the pipe 12 through inlet pipe 18 depends on the degree of oxidation required for the concentrated black liquor. For a 1000 tonnes per day (tpd) capacity pulp mill, about 7 to about 25 tpd of oxygen may be employed. In general, the oxygen dosage employed depends upon the required temperature increase of the concentrated black liquor during passage through the pipe 10. The energy released from the reaction is approximately 87 kcal per gram mole of oxygen reacted with the black liquor solids. The oxidized and heated concentrated black liquor of desired temperature is removed from the outlet end 16. The oxidized and heated black liquor then is forwarded to the conventional black liquor recovery boiler.

The pipe 12 generally is maintained under a minimum pressure of about 35 psig (about 330 kPa) to prevent liquor flashing as a result of the increase of temperature brought about by oxidation of the black liquor solids. The pressure in the reactor generally may range from about 15 to about 90 psig (about 200 to about 700 kPa).

It will be seen, therefore, that relatively simple equipment is required for carrying out the oxidation process of the invention. Such equipment is easily installed within an existing pulp mill environment and is of low capital cost. Alternative equipment and procedures may be employed, as discussed above.

SUMMARY OF DISCLOSURE

In summary of this disclosure, the present invention provides a novel process for the treatment of oxidizable sulfur compound free concentrated black liquor to effect heating of the concentrated black liquor prior to feed to the pulp mill recovery boiler while, at the same time, decreasing the heating value of the solids contained in the concentrated black liquor. Modifications are possible within the scope of this invention.

What I claim is:

1. A pulping process, which consists essentially of the sequential steps of:

digesting cellulosic fibrous material with a pulping liquor comprising sodium sulfide and sodium hydroxide to form a pulp and a black liquor, first concentrating said black liquor and oxidizing oxidizable sulfur compounds in said black liquor to a stable form, thereby forming from said black liquor concentrated black liquor substantially free from oxidizable sulfur compounds, next preheating said concentrated black liquor substantially free from oxidizable sulfur compounds to form therefrom a preheated concentrated black liquor by dispersing an oxidizing gas into a flowing stream of said concentrated black liquor substantially free from oxidizable sulfur compounds contained in an elongate conduit, wherein said concentrated black liquor has a solids content of about 50 to about 70 wt % and a temperature of about 80° to about 150° C. when fed to an inlet end of said conduit, to effect exothermic oxidation of black liquor solids contained in said concentrated black liquor substantially free from oxidizable sulfur compounds to provide said preheated concentrated black liquor with a decreased heating value and increased temperature and to increase the solids loading capacity of a black liquor combustion step, then combusting said preheated concentrated black liquor to burn off carbonaceous material from said preheated concentrated black liquor and form a smelt, and processing the smelt to form white liquor for recycle to said digesting step.

2. The process of claim 1 wherein said oxidizing gas is oxygen.

3. The process of claim 1 wherein said oxidizing gas is fed to said concentrated black liquor at a rate corresponding to about 7 to about 25 tonnes per day of oxygen per 1000 tonnes per day of pulp produced by said pulping process to release up to approximately 87 kcal per gram mole of oxygen absorbed by said concentrated black liquor solids.

4. The process of claim 3 wherein said elongate conduit is maintained under a pressure of about 15 to about 90 psig (about 200 to about 700 kPa).

* * * * *